United States Patent [19]

Rogers et al.

[11] Patent Number: 4,466,378

[45] Date of Patent: Aug. 21, 1984

[54] COATING APPLICATOR HEAD

[75] Inventors: John Rogers, Nuneaton; David J. Redfern, Weedon, both of England

[73] Assignee: Dynamelt Limited, Wolvey, England

[21] Appl. No.: 392,708

[22] Filed: Jun. 28, 1982

[30] Foreign Application Priority Data

Jul. 2, 1981 [GB] United Kingdom ..... 8120522

[51] Int. Cl.[3] ..... B05C 5/02

[52] U.S. Cl. ..... 118/411

[58] Field of Search ..... 118/410, 411, 407, 412, 118/25, 26, 406; 427/420, 286

[56] References Cited

U.S. PATENT DOCUMENTS

| | | | |
|---|---|---|---|
| 3,091,216 | 5/1963 | Scotti | 118/406 |
| 3,206,323 | 9/1965 | Miller et al. | 118/411 X |
| 3,987,754 | 10/1976 | Achelpohl | 118/410 |
| 4,048,950 | 9/1977 | Rakowicz et al. | 118/411 X |
| 4,119,058 | 10/1978 | Schmermund | 118/411 |
| 4,371,571 | 2/1983 | McIntyre et al. | 118/410 X |
| 4,381,726 | 5/1983 | Hojberg | 118/DIG. 4 |

*Primary Examiner*—John P. McIntosh

*Attorney, Agent, or Firm*—Scrivener, Clarke, Scrivener and Johnson

[57] ABSTRACT

An applicator head, for applying a coating of material (e.g. hot-melt adhesive) to a passing ribbon comprises an extrusion slot disposed transverse to the direction of passage of the ribbon and arranged to apply a coating of material in at least one continuous band along the ribbon, and an arrangement for intermittently opening and closing an extrusion slot for applying a coating of material discontinuously in a band contiguous with said one band.

2 Claims, 6 Drawing Figures

COATING APPLICATOR HEAD

This invention relates to a head for applying a coating of material, particularly but not solely adhesive to paper.

In fields requiring adhesive to be coated on paper, for example in cigarette manufacture, it is highly desirable for the adhesive to be applied to a uniform thickness. There are also requirements in certain instances for the coating to be applied in a pattern with some areas left uncoated yet surrounded totally by coated areas, but this poses difficulties in providing uniform thickness throughout the coated areas.

For example in cigarette manufacture, it is required to wrap a strip of paper around the filter tip. Such tip paper requires a coating of adhesive, so that it will adhere when wrapped around the filter tip, yet it requires a predetermined band which is devoid of adhesive so as to permit the passge of ventilating air through the tip paper within that band. In the completed cigarette, this band extends circumferentially around the filter tip, the tip paper being wrapped around the tip with its opposite edges overlapped and adhered together. The uncoated band must stop short of these opposite edges of the tip paper, so that coated margins remain to effect adhering of said opposite edges together along their full lengths. A so-called skip-gap pattern of coating is applied to a passing ribbon of paper, from which subsequently the tip papers are cut. If the adhesive is a water-based adhesive, the paper ribbon passes the applicator head at a slow speed, enabling the coating to dry before the coated ribbon reaches a wind-up spool: in such case the coating of the ribbon, leaving well-defined uncoated bands in the required skip-gap pattern, is not difficult. However, the applicators used are not suitable for applying hot-melt adhesive: hot melt adhesives imply a far greater speed of applicator or speed of the ribbon being coated, and the application of the adhesive in the required well-defined skip-gap pattern then becomes problematic. Hot-melt adhesive is necessary for certain materials now being favoured for the filter tips themselves.

In accordance with this invention, there is provided an applicator head for applying a coating of material to a passing ribbon comprising an extrusion slot disposed transverse to the direction of passage of the ribbon and arranged to apply a coating of material in at least one continuous band along the ribbon, and means for intermittently opening and closing an extrusion slot for applying a coating of material discontinuously in a band contiguous with said one band.

In a first embodiment to be described herein, there is a single extrusion slot which is interrupted at its centre for ensuring a narrow uncoated line along the centre of the ribbon. A finger lies across a middle portion of each half of the slot and is intermittently retractable: thus each half-slot applies two continuous bands of coating with a discontinuous band between them.

In a second embodiment, a first extrusion slot is interrupted such as to provide the two continuous bands of coating to each side of the uncoated centre-line. Two further slots, transversely aligned with each other, disposed immediately adjacent t e first slot and aligned with respective ones of its interruptions and moreover provided with an intermittently operated flow-valve, serve to provide the discontinuous bands.

The two embodiments of applicator head thus provide what is known as a skip-gap pattern which has particular (but not sole) utility for the tip papers of cigarettes. The uncoated zones prove to be particularly well-defined rectangles and the coated zones are of uniform coating thickness, and the applicator heads are capable of high speed of operation.

Said embodiments of this invention will now be described, by way of examples only, with reference to the accompanying drawings, in which.

Figure 1:
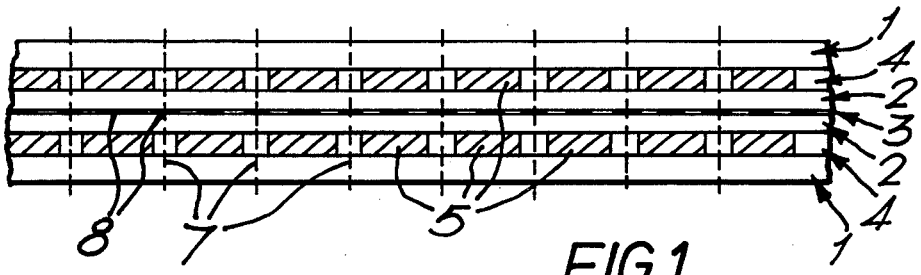
FIG. 1 shows a skip-gap pattern of adhesive coating on a ribbon of paper to be divided into cigarette tip papers.

FIG. 1 shows a ribbon of paper which receives two continuous bands 1,2 of adhesive to each side of an uncoated centre-line 3. Between each of the pairs of continuous bands 1,2 a discontinuous band 4 is applied, with rectangular gaps 5 uncoated. Eventual lines of severing into the individual cigarette tip papers are shown at 7,8: for each tip paper, the cut edges 7,7 form its said opposite edges which are overlapped and adhered together after the tip paper is wrapped around the filter tip.

Figure 2:
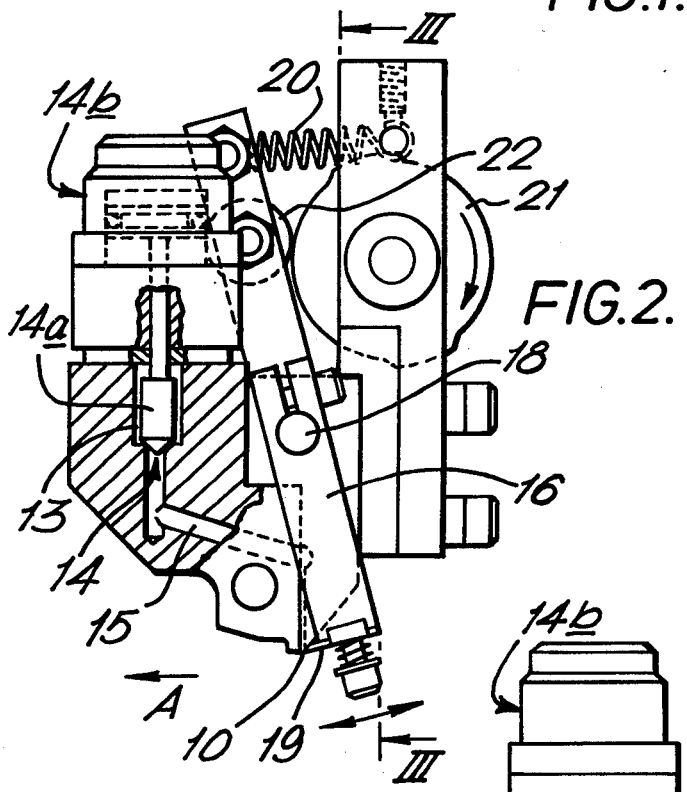
FIG. 2 is a vertical section through a first embodiment of applicator head for coating the ribbon as shown in FIG. 1.
Figure 3:
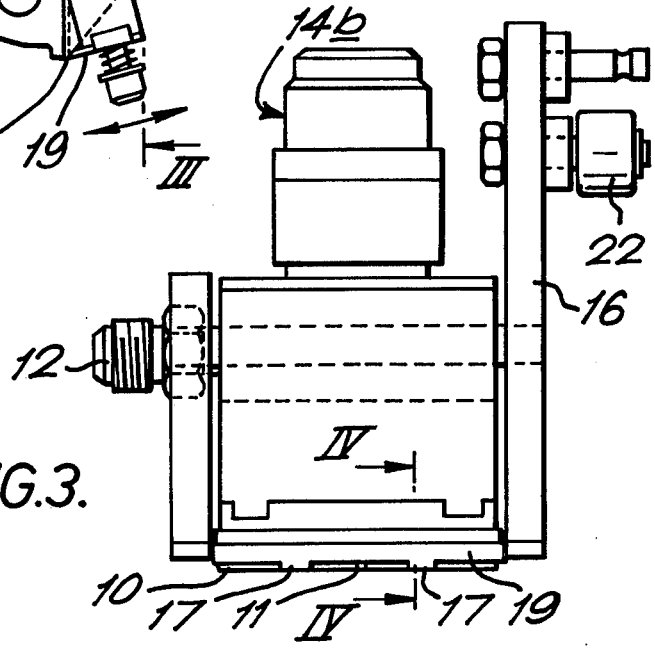
FIG. 3 is a section on the line III—III of FIG. 1.
Figure 4:
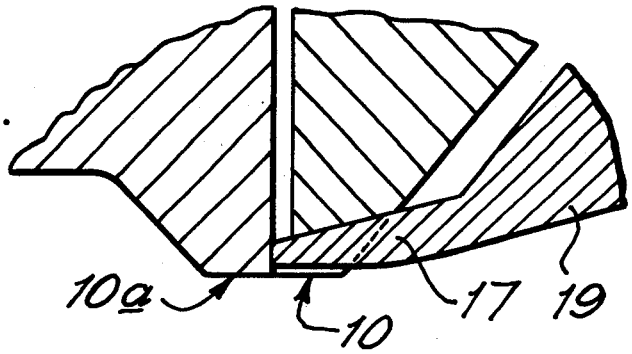
FIG. 4 is a section on the line IV—IV of FIG. 3, on enlarged scale.

Referring to FIGS. 2 and 3, the head comprises a nozzle with a single slot 10 interrupted at its middle 11 to form the uncoated centre line 3 (see FIG. 1). The slot 10 is fed with hot-melted adhesive from an inlet 12 to a chamber 13 and from thence via a valve 14 to a passage 15 leading to the slot. The valve element **14*a* is controlled for starting and stopping by a pneumatic actuator 14*b*. A lever 16 is pivoted at 18 and a plate 19 projects from its bottom end parallel to and adjacent the slot 10. Plate 19 includes two fingers 17 projecting towards the slot 10 generally at the middle of each slot half. A spring 20 biases lever 16 in the clockwise direction (as viewed in FIG. 2) so that fingers 17 normally close across the bottom of slot 10 (as shown in FIG. 3). A rotating cam wheel 21 acts on a cam follower roller 22 (mounted on lever 16) to intermittently rock lever 16 in the counterclockwise direction to retract fingers 17 from their normal positions, and thus fully open the two slot halves. Intermittent retraction of the fingers 17 in this manner serves to form the discontinuous bands 4 (see FIG. 1) whilst the normally fully-open portions of the slot serve to form the continuous bands 1,2. The direction of the passing paper ribbon is shown by arrow A in FIG. 2. FIG. 4 shows the profile of the applicator body adjacent the slot 10. The applicator body presents a narrow elongate surface 10*a* to contact the passing ribbon being coated. On one side of the slot 10, the body is cutback (from the plane of surface 10*a*) to provide space for the plate 19 and its fingers 17 to move. In the normal or closed position of the fingers 17 shown in FIG. 4, the ends of the fingers 17 abut one wall of slot 10 and the upper surfaces of fingers 17** abut the bottom surface of the cut-away portion of the applicator body (which bottom surface is inclined as shown).

Figure 5:
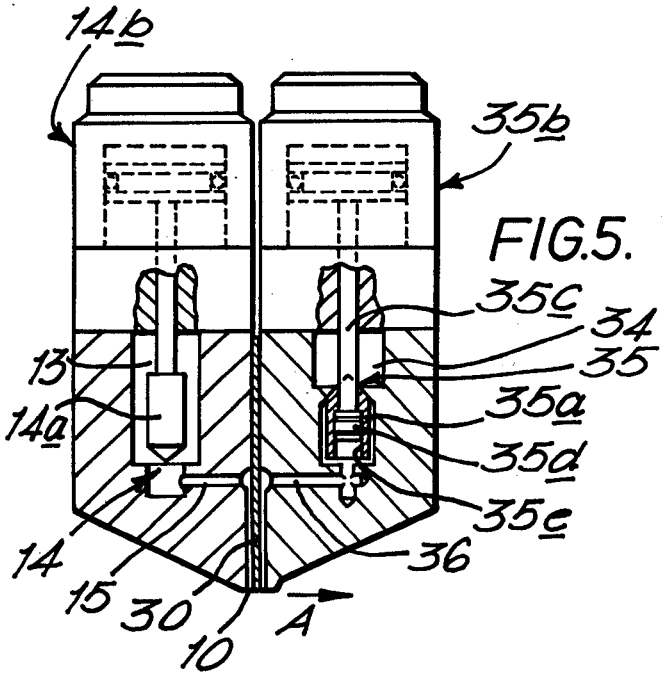
FIG. 5 is a vertical section through a second embodiment of head for the same purpose.
Figure 6:
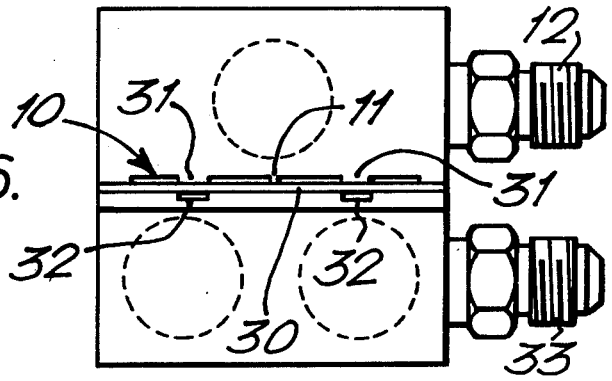
FIG. 6 is a bottom view of the applicator of FIG. 5.

Referring to FIGS. 5 and 6, the head in effect comprises two nozzles back-to-back and on either side of a thin gauge plate separator 30. A first nozzle corresponds with the slot 10 of FIGS. 2 and 3 and associated parts are referenced similarly, but is interrupted not only at 11 for the uncoated centre line 3 but also at 31,31 for the discontinuous bands of coating. Thus, to each side of the centre line 3, the slot 10 has two fully open portions for forming the continuous bands 1,2.

Whilst the interrupted slot 10 is disposed against one side of separator plate 30, two slots 32,32 (of the same widths as slot 10) are disposed against the other side of that plate, in precise alignment with the interruptions 31,31 of the slot 10. Slots 32 are provided with their own feed from an inlet 33 to a chamber 34 and from thence via a valve 35 to a passage 36 leading to the slots 32. By intermittent opening and closing of the valve 35 by means of its pneumatic actuator **35*b*, adhesive is intermittently allowed to pass to the slots 32 for formation of the discontinuous bands 4 on the paper ribbon passing in the direction of arrow A. Valve 35 comprises a valve member 35*a* freely slidable on valve stem 35*c*, and a piston 35*d* at the end of stem 35*c* slides within a bore 35*e* formed in the end of valve member 35*a*; in operation, when stem 35*c* moves upwards, firstly valve member 35*a* closes onto its seat to stop the flow of adhesive, then the piston 35*d* continues to move upwards within the bore 35*e* to create a partial vacuum at the upstream end of passage 36 to inhibit drainage (through slots 32**) of any of the adhesive remaining in that passage.

Both embodiments of applicator provide a positive, rapid and clean cut-off and cut-in of adhesive flow from the slots 10 or 32 upon closure and reopening by the fingers 17 (in the first embodiment) and by the valve **35*b*** (in the second embodiment).

We claim:

1. An applicator for applying a coating of material to a passing ribbon, comprising a head having a normally open extrusion slot disposed transverse to the direction of passage of the ribbon, means for supplying coating material to said head having portions adjacent opposite sides of the slot in continuous wiping contact with the ribbon during passing of the ribbon, a retractable finger which lies across an intermediate portion of said slot intermediate its ends, and means for repeatedly retracting said finger from across said slot and returning it to position it across said slot again, whereby said slot coats two continuous bands of material on said ribbon, which bands are spaced by the width of said finger, and a discontinuous band between and contiguous with each of said two continuous bands.

2. An applicator head as claimed in claim 1, in which an interruption is provided at the centre of said slot, dividing said slot into two halves, with said retractable finger lying across a middle portion of one half of the slot and a second retractable finger lying across a middle portion of the other half of said slot.

* * * * *